US006666681B1

(12) United States Patent
Do

(10) Patent No.: US 6,666,681 B1
(45) Date of Patent: Dec. 23, 2003

(54) CIRCULATING AGRICULTURAL BUILDING HEATERS

(76) Inventor: Trung Quang Do, 10976 Whitby Hall, St. Louis, MO (US) 63044

( * ) Notice: Subject to any disclaimer, the term of this patent is extended or adjusted under 35 U.S.C. 154(b) by 0 days.

(21) Appl. No.: 10/395,959

(22) Filed: Mar. 25, 2003

(51) Int. Cl.[7] ..... F24H 1/34

(52) U.S. Cl. ..... 432/219; 432/201; 237/3; 119/304

(58) Field of Search ..... 432/86, 143, 144, 432/145, 189, 196, 201, 207, 219, 220, 249; 236/2, 6; 237/3, 14; 126/85 A; 119/304, 307

(56) References Cited

U.S. PATENT DOCUMENTS 2,669,392 A * 2/1954 Schwanger et al. ..... 237/48
4,369,030 A * 1/1983 Siccardi ..... 432/37
4,504,011 A * 3/1985 Farrell ..... 237/14
4,852,799 A * 8/1989 Grant et al. ..... 237/3

* cited by examiner

*Primary Examiner*—Gregory Wilson
(74) *Attorney, Agent, or Firm*—Norman L. Wilson, Jr.

(57) ABSTRACT

Agricultural forced air heaters marketed for use in farm buildings which house poultry, swine, and livestock are quite susceptible to the accumulation of dust and other particles. These heaters are gas fired units having combustion, air mixing, blower and blower motor components assembled in a parallelepiped housing. To admit incoming air for their blowers and burners the heaters have multiple openings in the form of grid-like air intake ports on various heater sides. In the environments in which they are used the extensive use of air intake holes is a disadvantage. In the heater herein panels form four distinct chambers, a blower chamber, an air mixing chamber, a motor chamber, and a combustion chamber. Air inlets open into the motor chamber as the only air inlets in the heater housing. These air inlets provide all of the air for the heater. The airflow within the heater thus is unidirectional, flowing, when the blower is operating, from the motor chamber into both the mixing chamber and the combustion chamber, and then into the blower chamber.

7 Claims, 7 Drawing Sheets

CIRCULATING AGRICULTURAL BUILDING HEATERS

CROSS-REFERENCES TO RELATED APPLICATIONS

There are no applications related to this application.

FIELD OF THE INVENTION

In its broader aspect this invention pertains to agricultural building heaters, that is, heaters, frequently called agricultural heaters, designed for use in farm buildings which house poultry, swine, livestock, and, in some instances, grains. More specifically the invention relates to gas fired circulating heaters having burner-fan assemblies widely used, among other buildings, in poultry or brooder houses.

BACKGROUND OF THE INVENTION

Since the most important use of the heaters provided herein will be their installations in poultry houses where chickens and turkeys are grown, that aspect of the invention will be emphasized herein. The aim in poultry growing is to provide conditions that enable chicks to expend energy to increase body weight. Such a goal desirably results in larger, more saleable birds which resist disease. Temperature variations, however, cause chicks to expend energy to sustain their body temperatures rather than to increase their body weights. Such poultry house temperature variations thus lead to smaller, less desirable chickens and turkeys. Temperature variations can also create conditions during which weaker chicks contract diseases that can spread to healthier chicks. Obviously poultry farmers desire to maximize productivity by producing as much meat as possible for the feed consumed. Maintaining proper temperatures, then, is very important in effective poultry growing. It is desirable to keep poultry warm so that the food energy provided produces a gain in weight rather than body heat. To this end, for years the poultry industry has recognized the importance of allowing growing birds to choose their most comfortable areas. In order to provide such microclimates to precisely control them at the growing level, the poultry industry has relied on gas fired heating systems that typically include a plurality of gas burner assemblies in poultry houses. By strategically locating those heating assemblies throughout a poultry house, it is possible to provide an environment which is conducive to the growth of the birds in the flock.

There are two types of heating assemblies currently provided for poultry houses, radiant heaters, and forced air or fan heaters. However only radiant heaters appear to have found their way into the patent art. These radiant gas burner assemblies resemble outdoor yard gas lights, except that they are adapted to be suspended by chains and the like above the flock rather than being mounted on posts like the light fixtures. The most popular radiant heaters are the radiant screen type burners, a few examples being found in such patents as U.S. Pat. Nos. 5,964,214, 5,950,615, 5,328,357, and 4,614,166.

Radiant heaters are not completely satisfactory because they warm the growing birds but not the air. They heat only the side of the body that is within the reflective zone of the heater's parabolic reflector. Humans can rotate their bodies to obtain some measure of comfort using the heat emanating directly from such heaters. But it is unlikely that chickens and turkeys will flip over to balance their heat intake. In addition since a radiant heater's heat and light intensity are directly proportional to the gas input, it is impossible to maintain total darkness when the heaters are in operation. These disadvantages have led to the use of forced air heaters in poultry houses. Since a forced air heater is essentially a very hot flame with a fan behind it pushing large amounts of cold air passed the hot flame there is little room for improvement in such apparatus. This may account for our failure to find them in the patent art. The prior art, then is in the form of brochures published by the companies producing the heaters now on the market, such as the Airstream and Cumberland divisions of GSI of Assumption, Ill., Shenandoah Manufacturing Co., Inc. of Harrisonburg, Va., and Hired-Hand of Bremen, Ala. These heaters have numerous air inlets to admit those large amounts of air. Another popular gas fired heater, the L B White heater, sold by such companies as Gas Works in Yalesville, Conn., and Fort Recovery Equipment Co on line, is also provided with multiple air inlet ports. Fan heaters are generally mounted, not near the ceiling, but a few feet above poultry house floors in order to blow the heat generated by the burner close to the growing birds.

It is difficult to keep the ground warm when heavier colder air settles on it naturally. This has led poultry growers to attempt to lower, even more, their heaters, say to within inches of the floor to supply sufficient air to warm the dirt floors, especially when baby chicks are first introduced into a poultry house. The lowering of the heaters prevents the bedding area from becoming too cold, but it introduces other problems. As will become apparent, agricultural forced air heaters currently marketed for use in poultry houses are not totally satisfactory when used close to the floor.

A problem which is somewhat unique to the poultry industry is that dry feed, feathers and excrement which accumulate on dry poultry house dirt floors produce a remarkably dusty environment. To their disadvantage agricultural forced air heaters on the market are quite susceptible to the accumulation of such dust and other particles. Because of the accumulation of debris the heaters being marketed cannot be used very close to the poultry house floors. Whether the air born contaminants are kicked up by the young birds or emanate from the birds themselves, they can be ingested by the heaters. Contaminated air drawn into commercially available heaters results in accumulations which are detrimental to the burner, the fan motor, and other parts of the heater. Debris settles on horizontal surfaces within the heater, as well as on various other heater surfaces. Since these surfaces must be cleaned, the resulting maintenance of such systems adds significantly to the overall costs of raising the young chickens or turkeys. If the maintenance is deficient debris can gradually diminish the burner flame. The debris also settles on the motor and blower wheel within the heater causing the motor to run at temperatures above its design temperature. Given this environment it can be appreciated that prior art heaters are subject to improvement. It is these improvements which are within the contemplation of this invention.

As will be explained in greater detail hereinafter in conjunction with FIGS. 1 and 2 of the drawings, in order to admit incoming air the for their blowers and burners the commercial heaters have multiple openings for incoming air in the form of grid-like air intake ports on various heater sides. Other forced air agricultural heaters on the market are provided with similar grids for incoming air, but they are spaced across the heater floor. In the environment described the extensive use of air intake holes is quite disadvantageous. The incorporation of inlet air openings such as those shown in FIGS. 1 and 2 in the drawings leads to the debris problems alluded to. The inclusion of numerous air inlet openings does provide for greater air flow, and does produce the amount of heat desired. However it is to be realized that the intake holes require compensating adjustments. For instance, the large number of holes render it more difficult to ignite the burner within the time period set by the sensor. A higher gas pressure is required to initiate ignition. Low gas pressures lead to unreliable or failed ignitions due to lean mixtures. After ignition a high gas pressure is also required to compensate for the high air volume that flows through the burner. Since the air-to-fuel mixture required to sustain combustion subjects the heater surfaces to higher temperatures, the outsides of the heaters are hotter to the touch. A higher gas pressure requirement can also be a drawback because some actual field conditions may not be adapted to provide such a high gas pressure demands.

Due to the amount of wet litter and natural perspiration associated with such animals as chickens, turkeys, and pigs, the air within these animal confinements frequently becomes humid. Under these humid conditions it is virtually impossible to prevent the accumulation of debris on the motor and on the blower wheel, as well as around inlet openings and air passageways. Over time the heater's internal air paths become restricted by accumulation, forcing the airstreams to make sharp turns. When this occurs there is a tendency for larger and heavier particles to fall out of the airstream as its velocity drops during changes in direction. If not removed, the deposits build up and become hardened by exposure to damp air. Eventually accumulations tend to form around the inlet openings and on critical surfaces. The buildup often decreases the air volume by obstructing the air passageways. The decrease in air volume, as previously noted, then causes the motor to overheat and run more slowly. In addition, since the heater's gas valve generally is not designed for variable operation, the reduced inflowing air yields a richer fuel which produces a longer, larger, flame which burns hotter and more erratically. This resulting flame increases the combustion chamber temperature, and often activates the heater's high limit switch or harms the inner working parts of the heater. As the debris continues to accumulate the motor will run less and less efficiently. By this invention forced air heaters for poultry houses are improved so that they do not permit accumulations such as those described. The result is that the heater, in effect, is self-cleaning. In addition the flame is not allowed to enter the blower wheel. The improvement herein also permits the poultry house heater herein to be suspended closer to the dirt floor than existing heaters.

Considering now one additional aspect, the eating habits of poultry are highly influenced by daylight hours. To take advantage of this, modern poultry growing techniques embody the practice by growers of simulating the passing of days by periodically darkening their poultry houses to create night-like conditions. The practice has been found to simulate different days. Undertaking this several times a day deceives the birds so that they eat more. This light control practice helps the birds grow faster. As an example, a free-range chicken usually requires up to ten months to attain a five and one-half pound dressed size. When light control techniques are employed chickens reach their five and one half pound dressed size in forty-two to forty-five days rather than the normal ten months. The net affect is that a grower can bring forth eight or nine flocks a year, thus greatly increasing the return on his investment.

Given the foregoing details relative to poultry house heaters it can be seen that militating against the light control practice is the fact that under certain less-than-optimum operating conditions, the higher gas pressure in prior art agricultural heaters causes a portion of the flame to be drawn into the blower wheel. The elongated portion of the flame entering the blower housing results in visible light which is then emitted through the heater's exhaust opening, precluding total room darkness. In addition, the prior art heaters in FIGS. 1 and 2 do not offer double-wall combustion chamber protection in the case of light and heat since they utilize one or more of the exterior housing panels as part of the combustion chamber. Total darkness is further compromised because combustion light is emitted through the multiple air intake openings that are incorporated in prior art exterior housing panels. The gas fired agricultural heater provided herein does not emit any light at its sides or bottom, thus allowing for total nocturnal or simulated nocturnal darkness conditions in the poultry house. Further, by the improvement herein the poultry house heater, unlike those in the art, does not permit conditions which cause richer fuel flames.

SUMMARY OF THE INVENTION

A widely used type of agricultural heater is improved by this invention. The type of heater improved is a gas fired, forced air or fan heater having combustion, air mixing, blower and blower motor components assembled in a box-like or parallelepiped housing. The improvement herein includes interior heater compartment-forming panels which in combination with roof and floor panels form four distinct chambers within the housing. One of these chambers is a center blower chamber provided with a hot air outlet. On one side of the blower chamber, with a common wall between them, is an adjacent incoming cool air-heated air mixing chamber. On the other side, also separated by a common wall, is an adjacent motor chamber, such that the three chambers are in series. The fourth chamber is a combustion chamber whose location depends upon whether the chamber houses a vertical burner, or horizontal burner, which is new to this art. A blower is supported in the center blower chamber with its axis perpendicular to the common walls. A blower motor is mounted in the motor chamber on the common wall between the motor chamber and the blower chamber with its drive shaft extending into the blower chamber to be coupled to the blower. Air inlets open into the motor chamber, and as the only air inlets in the housing, those air inlets provide all of the air for the heater. Incoming air then initially cools the blower motor. Air passageways are provided to allow air to be drawn from the motor chamber into the air mixing chamber when the blower is operating. An opening in the common wall between the air mixing chamber and the blower chamber allows mixed ambient temperature air and hot air to flow into the blower. Openings leading from the motor chamber to the combustion chamber also allow incoming air to be drawn into the combustion chamber when the blower is operating. A passageway leading from the combustion chamber to the mixing chamber directs hot air from the combustion chamber into the mixing chamber to be mixed with incoming, ambient temperature air, to produce additional heated air to be drawn into the blower. The airflow within the heater thus is unidirectional, flowing, when the blower is operating, from the motor chamber into both the mixing chamber and the combustion chamber, and then into the blower chamber.

BRIEF DESCRIPTION OF THE DRAWINGS

In addition to FIGS. 1 and 2, included to illustrate how air is drawn into prior art forced air agricultural heaters, additional drawings are included herein to illustrate the invention, and the best mode presently contemplated for carrying out the invention, as well as additional embodiments thereof.

DETAILED DESCRIPTION OF THE INVENTION

Figure 1:
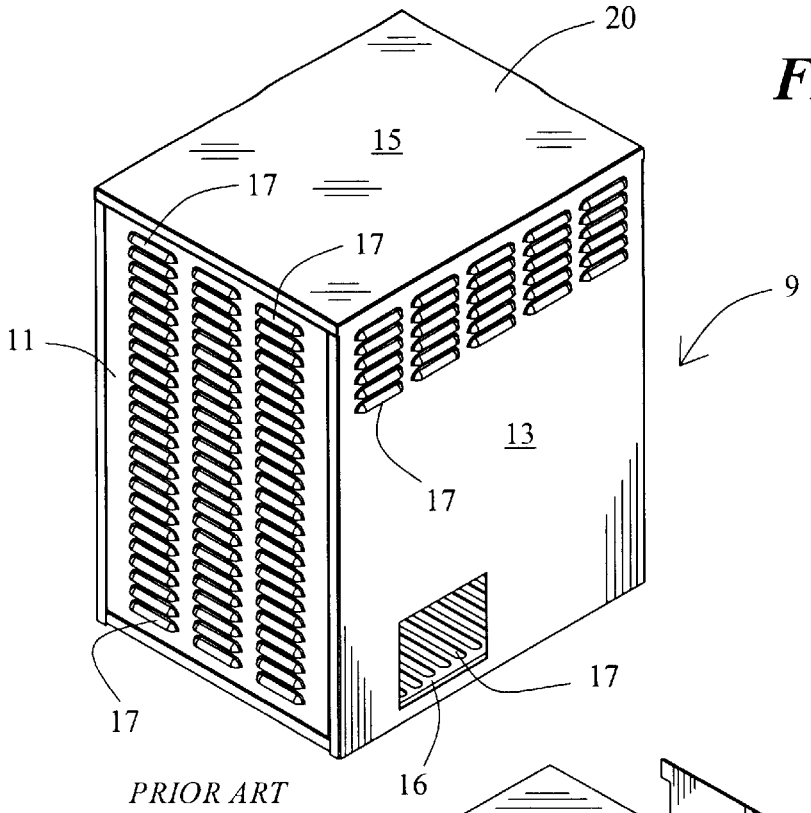
FIG. 1 is an isometric view illustrating the air inlet ports in one type of gas fired forced air agricultural heater currently on the market.
Figure 2:
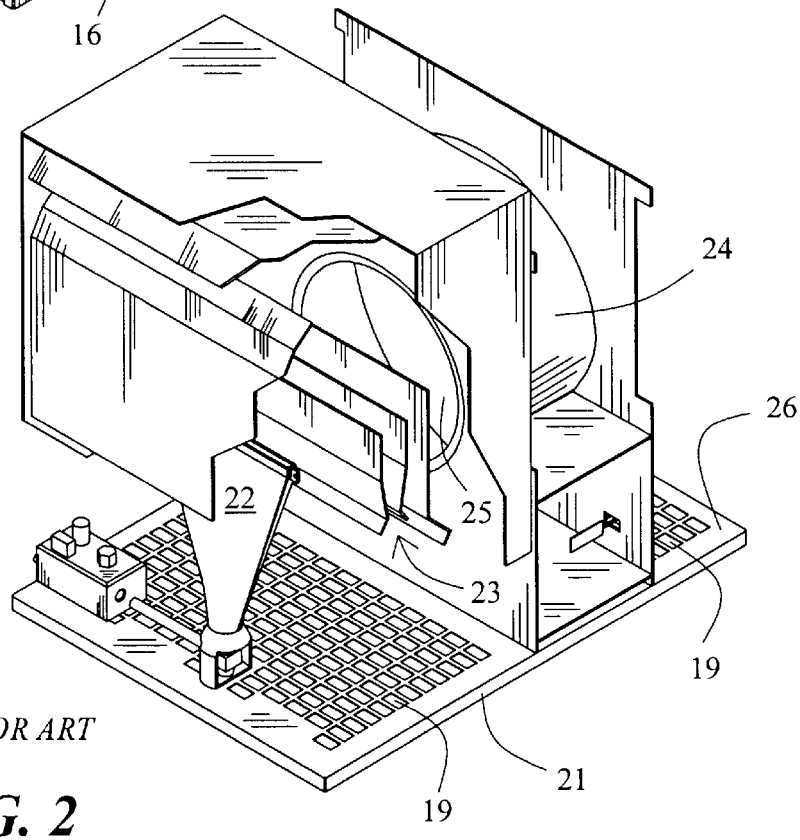
FIG. 2 is an isometric view illustrating another type of currently marketed agricultural heater with its housing removed to reveal the air inlet ports.

The prior art has been discussed quite fully, but for the sake of clarity, prior art FIGS. 1 and 2 have been included herein. FIG. 1 is an isometric view which illustrates the general configuration of agricultural heaters of the type usually suspended above floors in poultry and livestock houses. In its as-sold form, designated by the reference numeral 9, this class of heaters has its components assembled in a framework within a box-like or parallelepiped housing 20 preferably fabricated of metal.

Shown in FIG. 1 are side panels 11 (one being not visible), front panel 13 and a rear oppositely disposed panel, also not visible, along with top panel 15 and bottom panel 16 that form the parallelepiped housing 20. FIG. 1 is a view of forced air heaters widely sold by a well-known manufacturer. The extensive use of inlet air openings can be seen in the figure. This type of heater is provided with rectangular ports 17 in at least two of its panels, such as side panel 11, its oppositely disposed side panel, not shown, front panel 13, and its back panel, which also is not visible. As shown in FIG. 1, in this commercially available agricultural heater, even bottom panel 16 of housing 20 is provided with a number of air inlet openings or ports.

FIG. 2 is an isometric view of a highly commercial agricultural heater. These heaters carry their air intake openings 19 in the bottom or floor panel 21. The housing encasing the heater components has not been shown so that these ports can be seen. Ports 19 extend in rows all the way across the floor panel as shown and are so close together they resemble a grid-work. With the housing removed burner 22, flame deflecting baffles 23 and blower 24, with its inlet 25, are visible. Because of the huge number of air intake ports there is no separate mixing zone. The grid-work in the floor beneath the burner 22 is provided for heated air-cooled air mixing. The floor of motor area 26 is also provided with air intake ports 19. From this view of the grid-work it can be seen that the poultry house dusty environment is a matter of concern.

Figure 3:
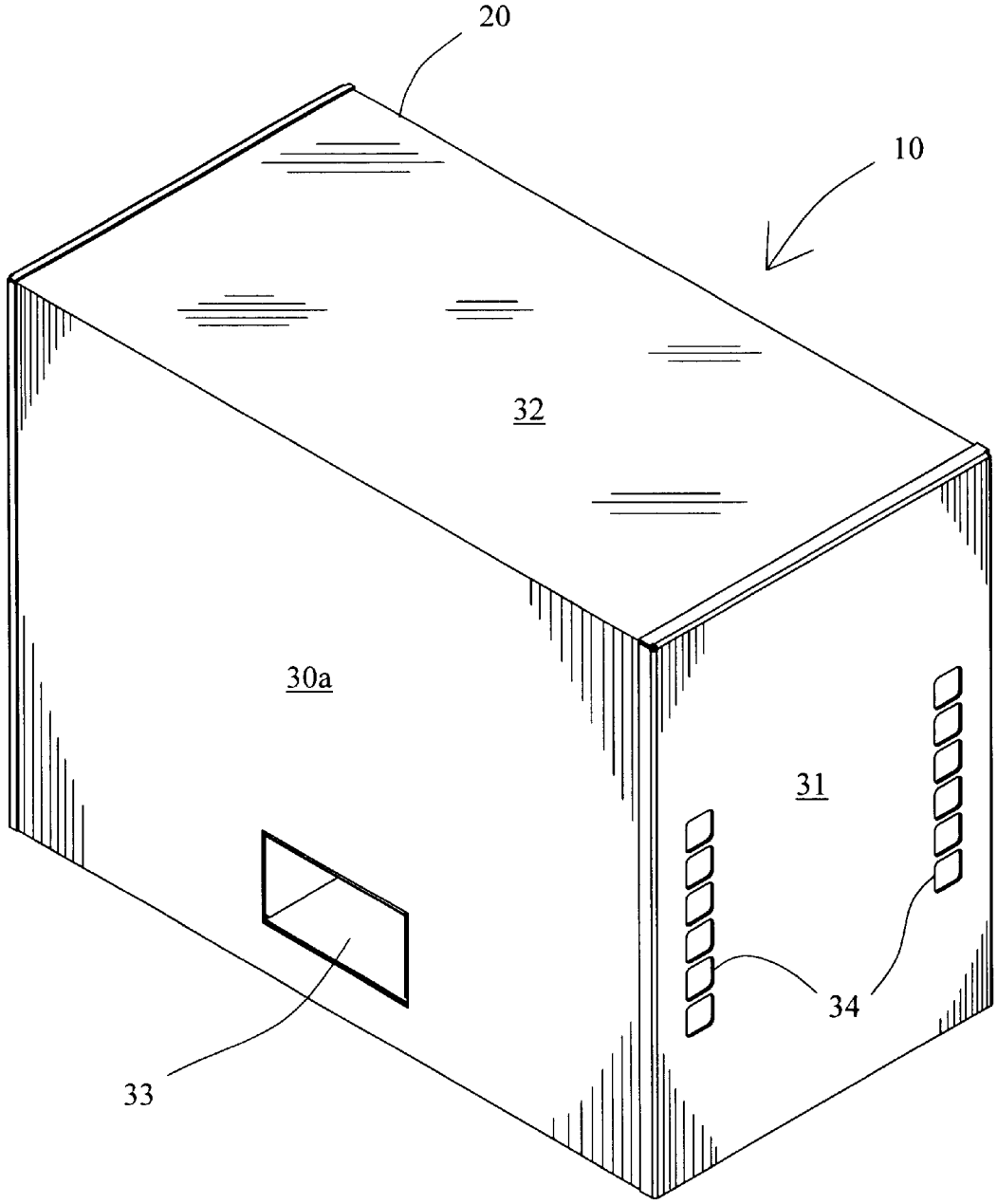
FIG. 3 is an isometric view showing the external appearance of the agricultural heater of this invention as it will be marketed.

Referring now to FIG. 3, shown in that figure is one embodiment of the forced air heater of this invention. It can be seen that the heater 10 is in the form of a parallelepiped structure formed by housing 20. The rectangular front panel 30*a*, a back panel (not shown), a rectangular side panel 31, the other side panel (not shown) and the top panel 32 are illustrated in FIG. 3, with the bottom panel not being visible. Front opening 33 is the hot air outlet, a modified form of which is to be discussed hereinafter. Also shown in the housing of heater 10 of the invention are rows 34 of inlet air ports in the side panel 31, which encloses the blower motor chamber. It is again emphasized that this series of openings 34 is the only air intake opening to the heater. It follows that the incoming air must flow from the motor area into all of the other functional areas. To achieve this flow the functional areas have been divided into chambers. This array of chambers will become clear by referring to FIG. 4.

Figure 4:
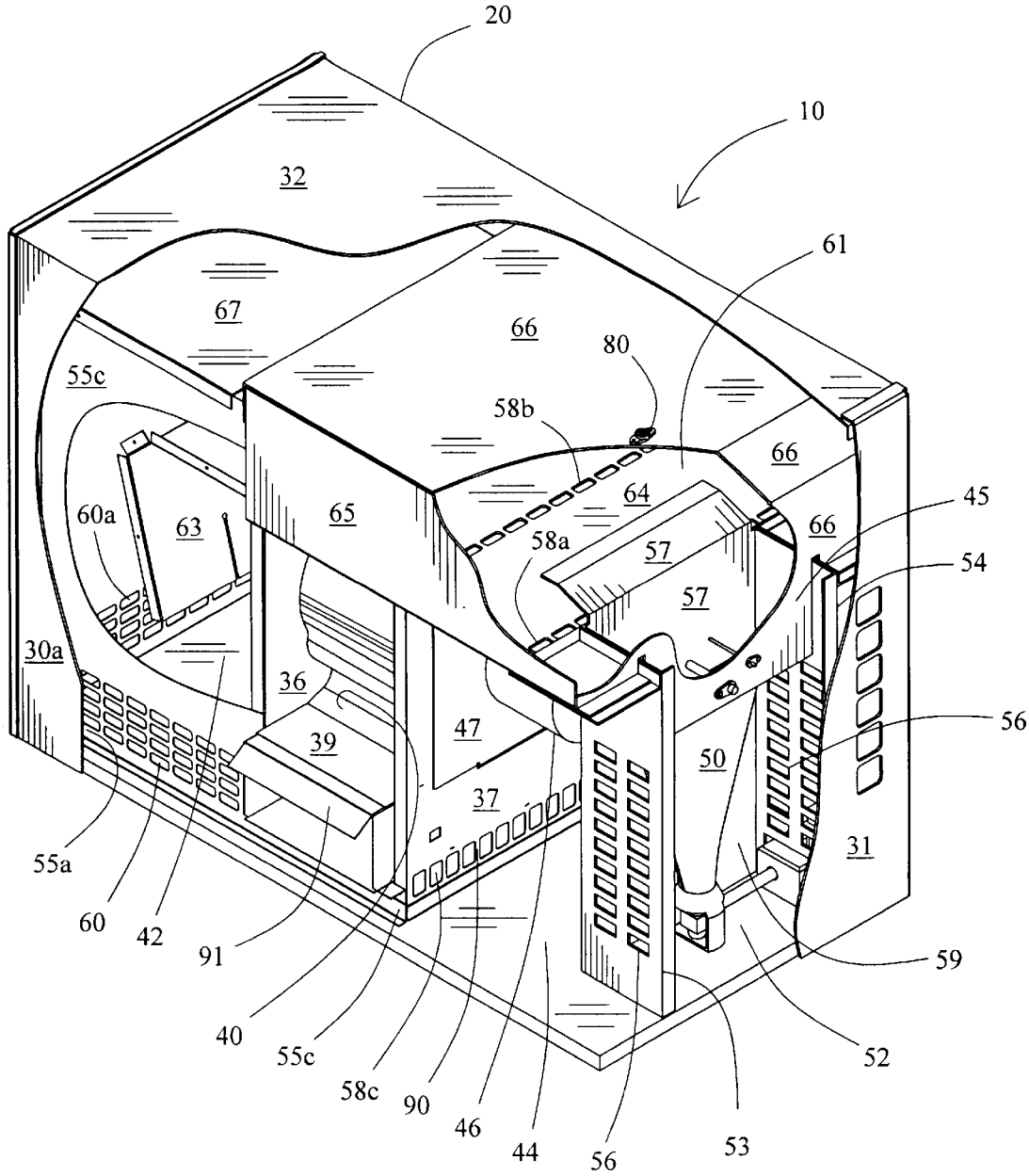
FIG. 4 is an isometric view, partially cut away, showing internal portions of one form of the heater of this invention.

FIG. 4 is an isometric view, partially cutaway, to show the internal portions of the heater of this invention. By the use of vertical panels 36 and 37 the heater herein has been divided into three separate chambers. Panels 36 and 37 are disposed as common walls parallel to the side panels, such as side panel 31, to form these three chambers. Between panels or common walls 36 and 37 blower 39 is mounted in blower chamber 40. It should be stressed at this juncture that the ignition system, the controls, the burner, the other heater components, and the blower are not the essence of this invention. Rather, they are those used in the prior art heaters mentioned hereinbefore. Thus the blower is a standard squirrel cage blower or fan chamber capable of delivering hot air at a rate of 520 to 2,000 CFM. Panel 36 serves as a common wall between blower chamber 40 and mixing chamber 42. In mixing chamber 42 incoming cool air, that is, ambient temperature air, mixes with hot air generated by the burner 50 in combustion chamber 52. The inner wall of mixing chamber 42 is the other side of common wall 36 between the mixing chamber and the blower chamber. The other common wall 37 is placed between blower chamber 40 and the motor chamber (44). Motor chamber 44 is fabricated to form an enclosure so that incoming air, before traveling through passageways to the mixing chamber, and through ports to the combustion chamber, first cools the motor. Motor 46 is mounted on a motor plate 47 so that the entire motor and plate assembly can be mounted/removed from common wall 37 as a unit. Motor 46, then, is mounted on the motor chamber side of common wall 37 with the drive shaft of motor 46 extending through common wall 37 in alignment with the axis of blower 39. The motor drive shaft is coupled to the blower so that blower 39 is driven by the motor, say, a standard one-eighth, one-fourth or one-third horsepower electric motor.

Vertical burner 50 is housed in a separate combustion chamber 52 which is formed by sidewalls 53 and 54 and a back wall 59 behind burner 50. Burner 50 can be a readily available gas-fired (LP or natural gas) direct spark or hot surface ignited burner having an output of 5,000 to 250,000 BTUH. Combustion chamber sidewalls 53 and 54 are provided with air intake ports 56 for the passage of air from the motor chamber 44 where it is first drawn in through ports 34 of FIG. 3. Combustion chamber 52 includes the area enclosed by chamber walls 53 and 54, burner 50, and baffle 57, beneath which the flame is ignited. The baffle diverts the burner flame from a vertical flame to a horizontal flame. Air openings 56 supply the air from motor chamber 44 for ignition. The ignited burner flame is deflected by arcuate baffle 57 into channel 61 and is then drawn around baffle 63 by blower 39 into mixing chamber 42 as will be explained further in conjunction with FIG. 6. In FIG. 4 heater top 32 has been cut away to show baffle 57 which confines and diverts hot air emanating from the burner so that it can be directed through channel 61 to the mixing chamber (42). Channel 61 is formed by inner combustion chamber sidewalls 65 (only one being visible), a channel bottom 64 and a channel top 66. It has been found that the long flame path provides additional burn time, leading to greater combustion efficiency and low carbon monoxide emission. One of the features of this embodiment is the provision of a long flame. To this end channel 61 is part of combustion chamber 52 as it extends across the tops of the three chambers 44, 40, and 42. Because of the long flame path, additional air, flowing from motor chamber 44, is supplied to the flame through openings 58*a* and 58*b*. This ensures complete combustion and provides a gas force partially lifting the flame above panel 64. The air entering combustion chamber 52 must be slowed down and reduced in volume so that dilution of the fuel mixture within burner 50 chamber is minimized. This downstream metering of air by ports 58*a* and 58*b* ensures that a rich fuel and air mixture is available for ignition, even when supplied gas pressure is lower than normally recommended.

Another improvement in this embodiment stems from the location of the heater air inlet openings (34 in FIGS. 3) relative to the air inlet openings (56 in FIG. 4) leading to the combustion chamber. As can be seen these openings are positioned at an angle to each other, and in close proximity. Inlet openings 34 are situated beside combustion chamber openings 56. Fast moving airstreams within an enclosed structure cannot make abrupt ninety degrees turns without slowing down or undergoing deceleration forces. To take advantage of this fact, air intake ports 56 (FIG. 4) are positioned at a 90□ angle relative to the main airstream entering the heater through openings 34. With this arrangement most of the incoming air does not make the ninety degrees transition through inlet ports 56. Rather, the larger quantity of incoming air drawn by the blower bypasses combustion intake ports 56 and moves on to inlet ports 55*a*, 58*a*, 58*b*, and 58*c*. (See FIG. 4). Most of the incoming air, thus, flows naturally upwardly around burner 50 toward baffle 57, with only a portion being drawn into the burner to mix with the supplied fuel vapor. Because of the small surface area of air inlet ports 34 relative to the heater's exhaust flow rate, a high airflow rate or velocity is achieved by this invention. For instance, with an exhaust rate of 800 to 1100 cubic feet per minute the average inlet air velocity through ports 34 in FIG. 3 will be increased to about 3200 to 4200 feet per minute due to the smaller surface area of inlet ports 34. An inlet air velocity of this caliber can lead to burner control problems. However herein, instead of injecting a high velocity air inlet stream directly into combustion chamber 52 a portion of the turbulent high velocity airstream is siphoned off by the arrangement of the two air inlets 34 and 56. The stream introduced into the combustion chamber through inlets 56 is a low pressure, slower moving, lower volume airstream in order to provide a desirable fuel mixture for ignition.

As implied in the preceding discussion of the increase in air velocity within the heater herein, one of the goals of the design of the heater is to create highly energized turbulent flow within it. A high velocity flow is important for both cooling and air metering functions. The generation and regulation of a turbulent airflow within the heater's interior plays an important role in keeping the exterior panels cool to the touch. Turbulent fluid flow is, thus, a desired flow characteristic. It is more effective than laminar flow at removing heat because it tends to break up the thin boundary layer that exists between a moving fluid and a surface. Its control not only promotes cooling, but that control also allows for an air metering capability inside combustion chamber 52. For this reason, inlet ports 34 (FIG. 3) are divided into smaller ports. Similarly, inlet ports 56 (FIG. 4) are divided into even smaller openings, preferably about one-half the size of ports 34. Since the path taken by the airstream from combustion 52, through channel 61, and finally to mixing chamber 42, is longer and more restrictive than the side and bottom channels of the heater, it is natural that the vacuum created in the combustion chamber by blower 39 is lower.

As indicated hereinbefore still another feature of this invention is the provision of a heater whose housing surfaces are not hot to the touch. In addition to the velocity aspect discussed, to accomplish this various air spaces or air gaps and built-in heat sinks (to be described) are included in the heater design. There is, for example, an air space 55*a* between panel 55*c* and the housing front wall 30*a*. A similar air space is fabricated along the back of the heater. Another air space is provided between housing top 32 and the tops 66 and 67 of combustion channel 61. In general these air gaps function as built in heat shields or heat barriers between the hot inner surfaces within the heater, and the exterior housing surfaces. The air gaps are sized for the amount of air that will be passing through them at the designed air throughput speed. As a guide, the air gap must not be so small that it generates a backpressure when the system is operating.

In addition to the cooling achieved by the air spaces, strips or dividers can be fabricated between various adjacent openings within the heater to function as heat sinks. An example is divider 90 in FIG. 4 between openings 58*c* which will lower the temperature of panel 37. Not shown are similar cooling webs or strips on panel 36. Though not shown, webs 90 in the preferred embodiment may be rotated in any included angle normal to the direction of airflow from plus 90-degree to minus 90-degree. In addition, by alternating the angle from one web to the next such that any two consecutive webs are at some included angle other than zero or 180 degrees, both heat transfer and turbulence generation are greatly enhanced.

The incorporation of an airstream temperature barrier can be better exemplified by a, discussion of the airflow through heater 10 of the invention. As explained in conjunction with FIG. 3 all of the air for the heater 10 enters motor chamber 44 through ports 34. When the blower is operating the incoming airflow divides so as to circulate in several airstreams flowing through various passageways toward the mixing chamber as will now be described in conjunction with FIG. 4. Since all of the incoming air drawn in through air intake ports 34 will be drawn toward the blower, it flows first into the mixing chamber (42). One airstream passes through openings 56 into the combustion chamber 52 as described hereinbefore in conjunction with ports 58*a* and 58*b*. This stream then splits into two components. One component flows into burner 50, and then into combustion channel 61. Channel 61 directs the heated gas stream into mixing chamber 42. The other component flows in a passageway 45 which is formed between the top side of combustion chamber roof 66, as well as 67, and the underside of heater top panel 32. After cooling the inside surface of housing top panel 32 the airstream component flows across the combustion chamber roof 66 and 67, and finally into mixing chamber 42 through ports 60*a*. Another airstream carries a greater quantity of air from the motor chamber through openings 58*c*. This stream flows beneath blower chamber 40 and behind inner panel 55*c* into the mixing chamber. The front and back passageways can be visualized by referring to 55*c* in FIG. 4. The incoming airstream flows into this passageway 55*a* between an inner panel wall 55*c* and housing front panel wall 30*a* on its way to mixing chamber 42. To adequately cool the front panel wall 30*a* of the heater airflow passageway 55*a* extends upwardly as far as top panel 67 (FIG. 4). After cooling the front heater housing wall, the air flows into mixing chamber 42 through ports 60 and 60*a*. A similar arrangement (not shown) exists along the back side of heater 10. The cooling of the heater floor is accomplished by the air entering the motor chamber 44 which then flows through ports 58*c* along the floor until it enters the mixing chamber. It is to be understood that the use of similar inner cooling passageways also prevents the side walls of the housing from becoming overly hot. It can now be seen that flow of air through the heater herein is indeed virtually unidirectional. It can also be seen that cooling streams flow in passageways or channels formed along the inside walls of all six sides of the parallelepiped housing of this invention.

DESCRIPTION OF A PREFERRED EMBODIMENT

In its preferred form the heater of this invention includes a horizontal burner. A horizontally disposed burner, new to this art, permits a longer than conventional flame path to be employed while also allowing for a controllable, compact, heating unit. By controllable we mean that with a horizontal burner the flame path can be so adjusted that it can be set to end just short of the blower entrance. Flame entering a blower is not only detrimental to the blower impeller, by unduly heating the blades, but the resulting flame is a source of light. In prior art heaters the numerous air intake openings are not fabricated to dispel light when darkness is desired in order to simulate the end of a day. By the same token light emanating because the tip of a flame entered a blower has not been dealt with.

Figure 5:
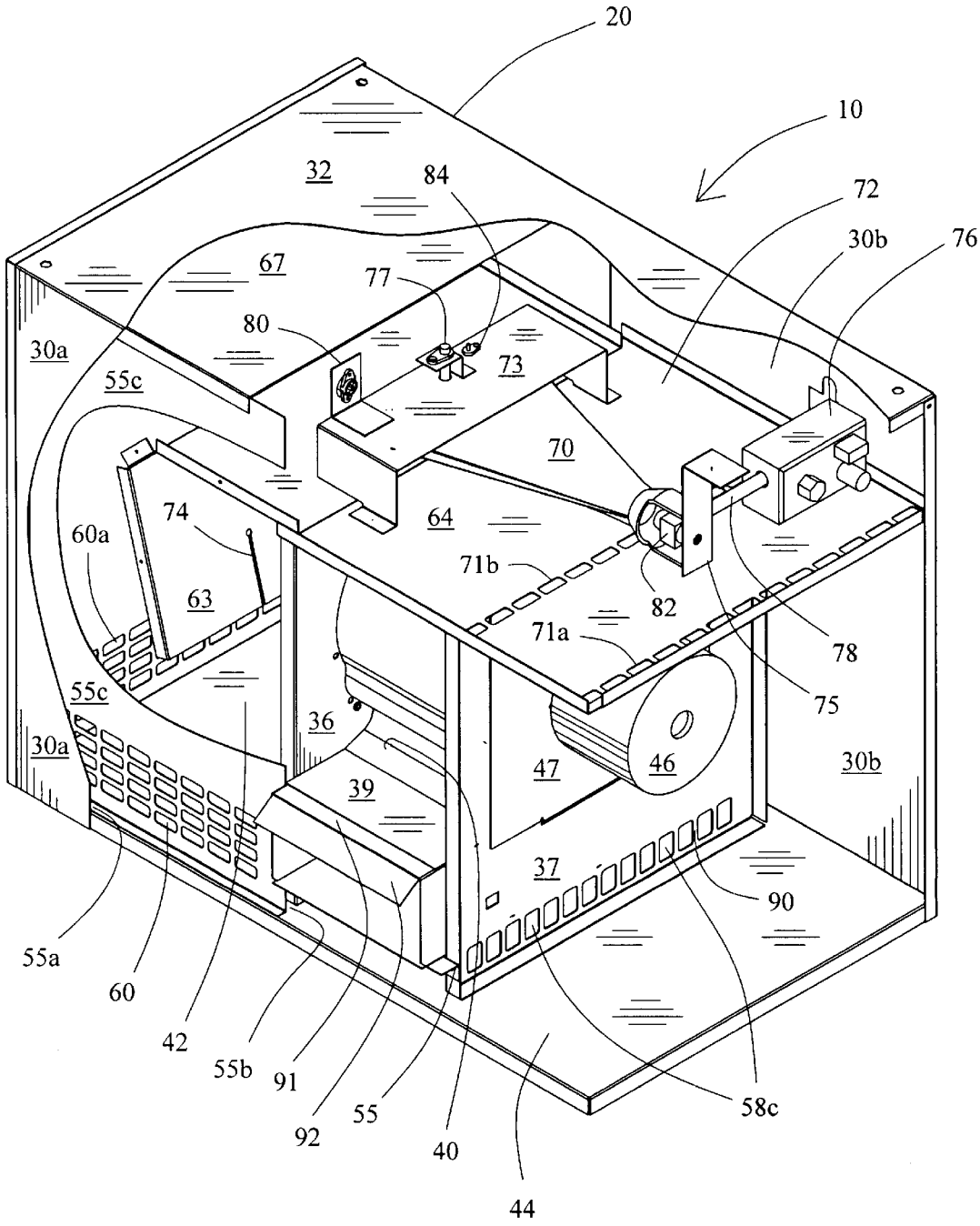
FIG. 5 is an isometric view, partially cut away, showing internal portions of the preferred form of the heater of this invention.

For a better understanding of a horizontal burner heater FIG. 5 is given. Referring to that figure it can be seen that combustion chamber 72 lays across the tops or roofs of motor chamber 44, blower chamber 40, and mixing chamber 42. Air intake openings or ports 71*a* and 71*b* provide air for ignition and combustion as did ports 56, 58*a* and 58*b* in the heater shown in FIG. 4. Burner 70 is supported in its horizontal position by brackets 73 and 75 which support the burner above the combustion chamber floor so that it can receive air from below through ports 71*a* and 71*b*. Also shown in FIG. 5 are an electronically actuated gas valve 76, an igniter 77, a gas pipe 78, a high temperature limit or automatic shut-off switch 80, and gas orifice unit 82. A flame probe 84 detects the presence of a flame. All of these components, for example, the electronically actuated gas valve 76, gas pipe 78, and the other heater parts shown are well known and, being readily available, are incorporated in the majority of the agricultural heaters of this type.

As can be visualized by viewing FIG. 5 the flame actually emanates beneath bracket 73 just above the common wall 36 between the blower chamber 40 and the mixing chamber 42. This means that there is no flame above motor chamber 44, and blower chamber 40. Their housing walls, then, need not be heat protected. Hence the housing front and rear walls 30*a* and 30*b* can serve as the walls of those chambers. Accordingly front heat barrier wall 55*c* and the corresponding back barrier wall terminate at the blower chamber common wall 36. Downstream from the blower flame the front and rear housing walls 30*a* and 30*b* are heat protected by inner heat barrier walls 55*c* and airflow passageway 55*a* as explained in conjunction with FIG. 4. The housing top panel 32 of the heater above the flame area is heat protected by heat shield or heat barrier panel 67 which is installed in the area above combustion chamber 72.

On further considering FIG. 5 it is to be realized that the motor, blower, and mixing chambers beneath combustion chamber 72 are structurally and functionally similar to those in the heater previously described in connection with FIG. 4. To repeat, then, all of the air for heater 10 first enters the motor chamber 44 through a single entry panel, that is, ports 34 in panel 31. In this embodiment also, the airstream divides to flow as several streams passing through various passageways, all in the direction of mixing chamber 42. As in the embodiment with the vertically disposed burner the airstream passes into the combustion chamber 72, this time through openings 71*a* and 71*b* which are similar in location to ports 58*a* and 58*b* in FIG. 4. Thus the arrangement and sizing of openings 71*a* and 71*b* serve the same basic functions as ports 58*a* and 58*b* in FIG. 4. They are designed to provide the same means for low gas pressure operation by slowing down the stream of air and reducing its volume. Concomitantly flame from burner 70 is drawn around the top of baffle 63 by blower 39 during operation. In prior art heating units the flame is deflected into the mixing area by a baffle. Rather, herein the flame travels horizontally and then makes almost a 180 degree downward turn across baffle 63 as it enters the mixing chamber. Slot 74 in baffle 63 is merely an expansion joint. In order to increase the quantity of hot air entering mixing chamber 42, another airstream carrying a greater quantity of air flows from the motor chamber 44, through openings 58*c* in the base of common wall 37. This airstream flows beneath blower 39, and, passes through openings, not visible, but similar to 58*c* in common wall 36 as it enters mixing chamber 42.

An additional feature herein is the provision of means for heat protecting the barrier walls themselves (See walls 55*c*, FIG. 5). To cool these front and back interior walls 55*c*, while further protecting front and rear housing walls 30*a* and 30*b*, additional passageways or channels are incorporated in the heater to direct airstreams on both sides of walls 55*c*. Returning to FIG. 5 it can be seen that in addition to passageway 55*a* directing air across the front of interior wall 55*c* as in the embodiment in FIG. 4, an additional passageway or channel 55*b* is included in this preferred embodiment. As can be seen the added passageway 55*b* emanates just below blower 39, and it directs a flow of air along the backside of inner wall 55*c* to protect the metal from which that inner wall is fabricated. The passageway formed behind barrier panel 55*c* thus allows air to protect both sides of that panel, and then to flow upwardly as far as top panel 67 before passing into the mixing chamber 42 through ports 60 and 60*a*. As in the vertically disposed embodiment, panels 36 and 37 also have cooling heat sink strips 90 formed between adjacent openings 58*c*.

An especially unique feature of the preferred agricultural house heater of this invention is its inclusion of not only a horizontal flame path, but a horizontal burner. Prior art heaters produce horizontal flames from burners having gas ports directed vertically with the resulting flame deflected ninety degrees into a horizontal flow. Such diverted flames are sensitive to disruptive flows of air. The horizontal burner of this invention, although illustrated in FIG. 5, is shown in greater detail in FIG. 6, which is a partially cut away side view of the portion of the heater, showing the horizontally disposed burner 70 as it is supported by bracket 73. Burner 70 lies across the top of panel 64 so that its flame is drawn across the top of arcuate panel 63, disposed in mixing chamber 42 adjacent blower chamber 40. It is to be pointed out that even after vertical flames in existing heaters are directed into horizontal flow, the flame is guided by a baffle above the flame to divert it downwardly into an ambient air-hot air mixing area. In other words the flame flows along the underside of a baffle, whereas, during operation, the flame herein is drawn across the top surface of the panel or baffle 63 as shown at 115*a* in FIG. 6. The distance of the burner element above the combustion floor panel, and the length of the baffle plate arc are such that the burner flame terminates at the end of the baffle rather than in the blower.

Figure 6:
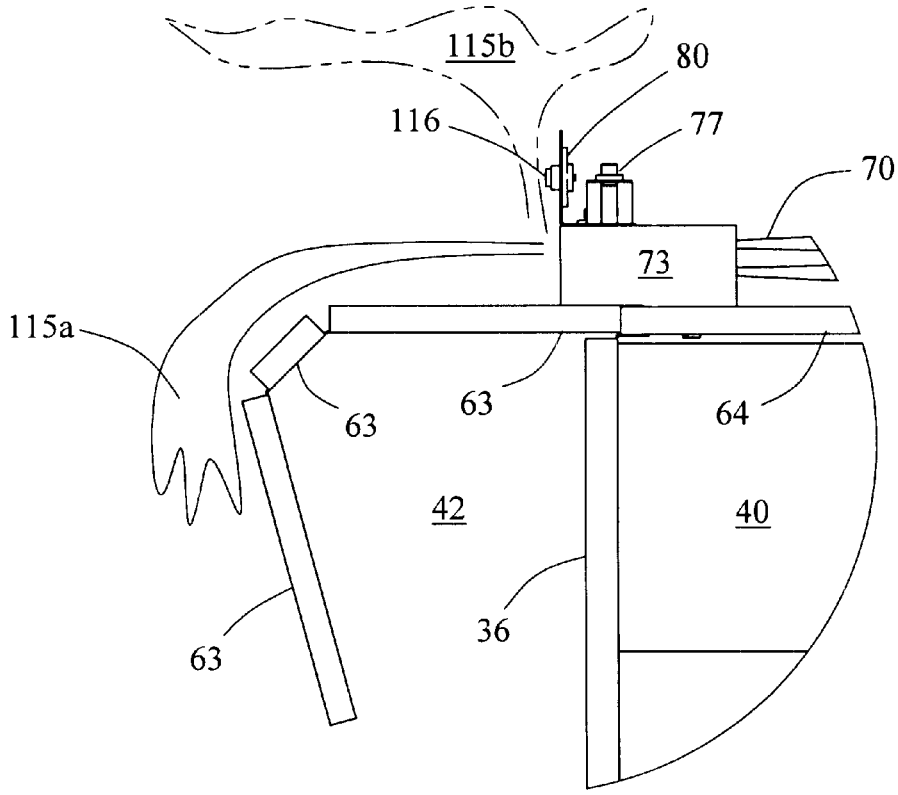
FIG. 6 is an enlarged side view illustrating the flame flowing from the horizontal burner depicted in FIG. 5.

Referring now in greater detail to the disruptive flow aspect, the diversion of a flame, say from the vertical to the horizontal, can lead to an erratic flame. Bracket 73 (FIG. 6) serves not only as a mounting platform for igniter 77, but for a high-limit switch 80 which causes the gas valve to close when the flame becomes erratic. Whether the flame is disrupted by a gust of air, or whether the disruption is caused by some restriction, it will loose its normal disposition, such as 115*a*, and assume some erratic disposition, such as 115*b*, shown by the phantom lines in FIG. 6. Some outside heaters employ various additional baffles, and even adjustable shutters, to ensure that unwanted gusts of wind do not disrupt their flames. Such precautionary measures are necessary to prevent an erratic flame from tripping the high-limit switch or the flame probe. Since the flame emanating from the burner illustrated in FIG. 6 is not diverted from a vertical to a horizontal disposition, but is ejected horizontally it is more stable. It is, therefore, less subject to disruption, and readily drawn across the top surface of arcuate panel 63.

Most prior art heaters have a high-limit switch mounted facing the flame some distance away from the burner's opening. However, as the flame travels away from a burner's opening, it is transformed from a coherent flame into an incoherent flame that resembles ends of paper streamers fluttering in the wind as can be seen by observing flame 115*a* in FIG. 6. Since their high-limit switch is often mounted only a few inches away from the incoherent portion of the flame, the flame can activate the high-limit switch initiating an overheating alarm which is false. As seen in FIG. 6, igniter 80 herein is strategically mounted very close to the origin of the flame 115*a*, and perpendicular thereto. There are two reasons for this. One, by mounting high-limit switch 80 close to the opening of burner 70 where the flame is more coherent, the switch is less likely to be affected by the incoherent end of the flame. Second, since the high-limit switch is mounted perpendicular to flame it receives a smaller amount of heat from the flame by convection and radiation, and therefore runs cooler. On the other hand, when a disruption causes flame 115*a* to rise upwardly as illustrated by phantom lines 115*b*, it will contact the sensing surface 116 of high-limit switch 80 and bring the sensor to its activation temperature in less than a second, safely shutting of the gas valve before internal components are subjected to destructive overheating.

Figure 8:
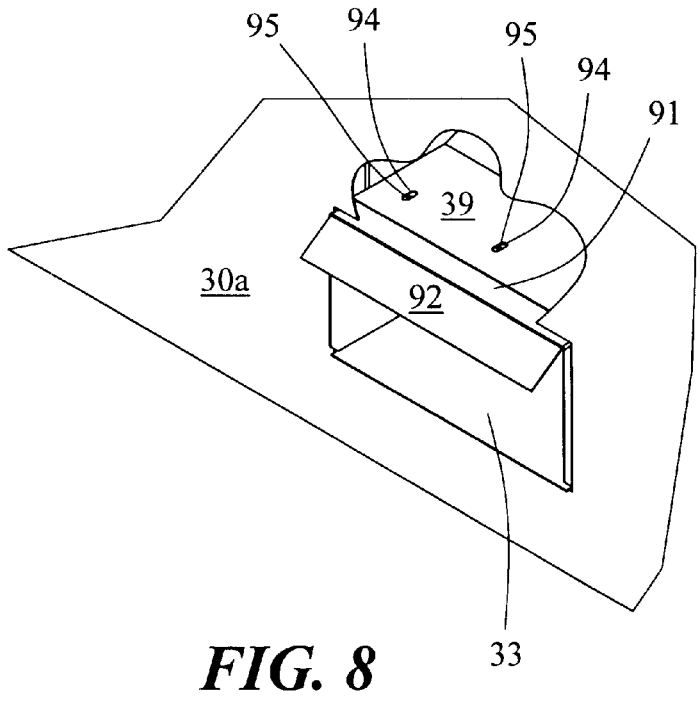
FIG. 8 is an isometric view, partially cut away to show, in greater detail, an entire deflecting plate assembly.
Figure 7:
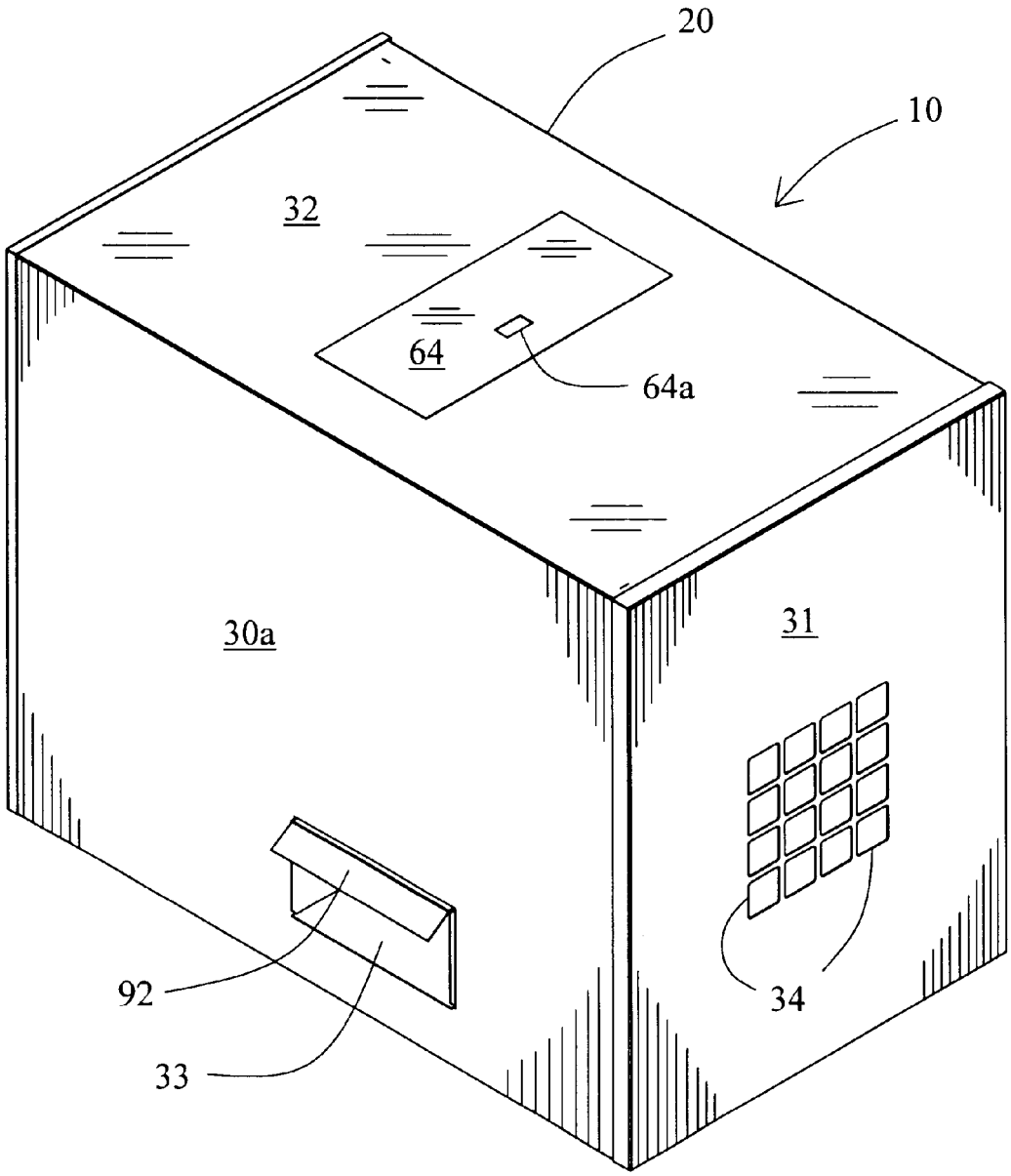
FIG. 7 is an isometric view, similar to FIG. 3 but showing added outlet deflecting plate and viewing port embodiments.
Figure 9:
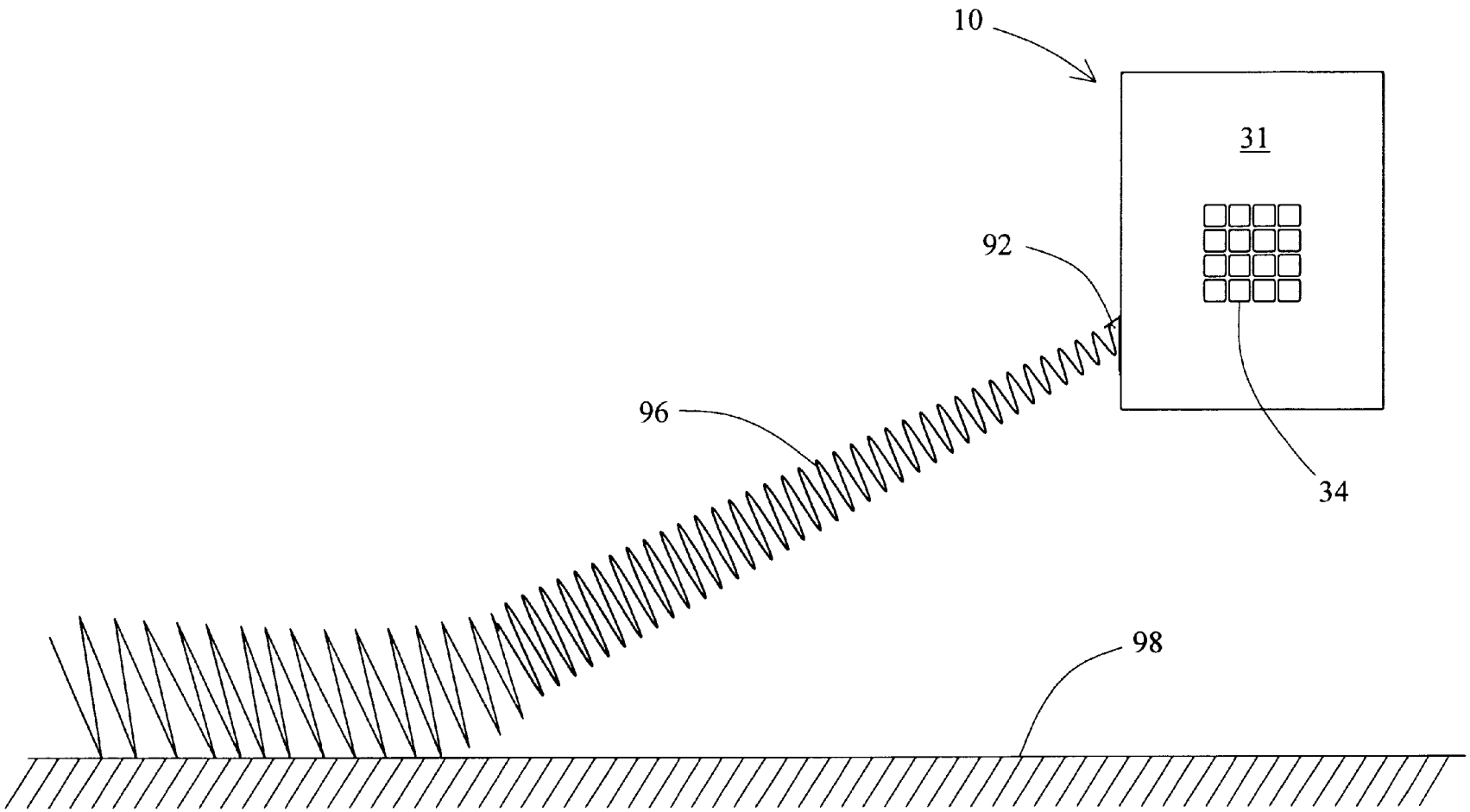
FIG. 9 is a side view of the heater of the invention showing a vortex created by the deflecting plate assembly of FIG. 8.

Also unique to the agricultural heater of this invention is the disposition of the deflection plate or awning 92 illustrated in FIG. 7. For this embodiment we refer now to FIGS. 7, 8, and 9. Through testing and test results it was discovered that unexpected advantages were obtained by the use of a heater outlet deflection plate, the entire assembly 91 of which is shown in FIG. 8 as an enlarged portion of the heater outlet partially cut away. As can be seen in FIG. 8 deflection plate 92 is attached along the top edge of hot air outlet 33 in front panel 30*a*. Supported in hot air outlet 33, the angular deflection plate 92 formed from a single piece of sheet metal or fabricated as a short awning made of plastic. When the inclusion of a deflection plate was planned it was intended merely to deflect the outlet hot air downwardly to compensate for the elevation of the heater. However, instead of merely deflecting the hot air downwardly, to then rise because of its lighter weight and loss of forward momentum, it was found that when the deflection panel 92 herein was curved downwardly to form an angle of about 30 degrees with the horizontal it generated a flow resembling a horizontal vortex, diagrammatically illustrated in FIG. 9. The vortex 96 emanated at the tip just below deflection plate 92 and rotated along the floor 97 as seen in FIG. 9. It was also found that the vortex enhanced the mixing of hot air flowing out of the heater with ambient air in the poultry house. Having made this discovery, we devised a series of tests to better quantify the flow pattern and relative strength of these horizontal vortices. By placing streamers or paper strips and small 1"×1"×4" rectangular foam blocks on their ends at two feet increments along the floor, we were able to observe the flow pattern and force of the vortex. With the heater suspended at a height of 28 inches from the floor, the mixed hot air-ambient air vortex knocked over rectangular blocks placed as close as six feet from the heater outlet, and those as far away as 28 feet as it rolled along the floor. It then remained to observe how the horizontal vortex enhanced the mixing of hot and cold air at the ground level. In order to create a colder and denser air ground level atmosphere similar to that in a poultry house on a typical winter day, a three-inch thick fog blanket was created using dry ice and water. To prevent ambient air from skewing the results, cold air was introduced into the test area for fifteen seconds prior to the test. Within seconds, the heated air from heater outlet 33 began rotating in a cyclonic manner, quickly dispelling the fog blanket and knocking over all of the foam blocks within sixteen feet of the heater. Fifteen seconds or so later the rotating airstream or vortex knocked over foam blocks positioned as far away as the twenty-eight foot marker. Even though the force of the vortex had decreased so that it did not knock over the remaining foam blocks, it continued to disperse the fog and dust particles on the floor for at least six additional feet. In the same tests, using commercially available heaters, the hot airstream leaving the heater quickly rose from its twenty-eight inch baseline to approximately six feet by the time it reached the twelve-foot mark. It did not knock over a single foam block or cause any of the paper streamers to flutter. These observations and test results showed that the rotational momentum induced by the deflection plate prevented the hot airstream from rising naturally toward the ceiling.

Having been given the teachings of this invention modifications will occur to those skilled in the art. Thus, instead of being fabricated so that it is integral with the front heated wall, deflection plate 91 can be made as an assembly with a portion extending into, or forming a part of air outlet 33 as illustrated in FIG. 8. The assembly can also be adapted to be secured to the blower housing roof. The top of blower housing 39 and the inner portion of the deflection plate can be provided with a series of mounting holes 95 (two being visible) arranged to allow for front-to-back adjustments. Slots 94 on blower housing top 39 can also be included to provide fine adjustments for deflection plate assembly 91. While deflection plate assembly can be clearly visible when in its fully extended position as in FIG. 8, it can be retracted and hidden from view. As another variation a peephole with or without a glass or clear plastic window, such as 64 in FIG. 7, can be installed for observing the flame and the mode of operation of the heater as well as for other purposes. As still another modification, in lieu of two rows of incoming air inlet ports 34 as illustrated in FIG. 3, any arrangement of incoming air inlet ports can be employed, one example being the rows of inlet ports 34 also shown in FIG. 7. In addition none of the air ports need be configured as shown, but can be circular, triangular, or in any other desired shape. Likewise the vertical burner need not be adjacent the motor chamber, but can be placed in any of several other locations. Other such ramifications which will be obvious to those skilled in the art are deemed to be within the scope of this invention.

What is claimed is:

1. In an agricultural heater of the forced air type having combustion, air mixing, blower, and blower motor components assembled within a parallelepiped housing, the improvement including: (a) an internal heater structure within the housing in the form of supporting wall panels which along with roof and floor panels, form four distinct chambers, a center blower chamber provided with chambers on each side, a hot air-ambient air mixing chamber on one side of the blower chamber with a common wall between them, a motor chamber on the other side of the blower chamber with a common wall between them, such that the three chambers are in series, and as a fourth chamber, a combustion chamber, located adjacent one of the other chambers, (b) means supporting a blower in the center blower chamber with its axis perpendicular to the common walls, and its exhaust parallel thereto, (c) means supporting a blower motor on the motor chamber common wall with its drive shaft extending into the blower chamber, (d) means coupling the blower motor drive shaft to the blower, (e) an opening in the mixing chamber common wall to allow mixed hot air-ambient air to flow into the blower as hot air, (f) a heater outlet at the blower exhaust in the blower chamber, (g) an incoming air inlet, opening into the motor chamber, that opening being the only air inlet to the heater so that incoming air initially cools the blower motor, (h) air passageways in the motor chamber to allow air to be drawn from the motor chamber into the air mixing chamber when the blower is operating, (i) an opening in the motor chamber to allow air to be drawn from the motor chamber into the combustion chamber when the blower is operating, (j) a channel connected to the combustion chamber to direct airflow from the combustion chamber into the mixing chamber, the airflow within the heater thus being unidirectional, flowing from the motor chamber into both the mixing chamber and the combustion chamber and from those two chambers into the blower when the blower is operating.

2. The heater of claim 1 wherein air passageways are constructed between the internal heater structure and the housing for the passage of incoming air from the motor chamber in order to cool housing surfaces.

3. The heater of claim 1 wherein the combustion chamber is mounted on the internal structure roof panel, with the roof panel serving as a floor, and wherein additional panels form an enclosure serving as the combustion chamber itself, and wherein that combustion chamber includes (k) a burner element bracket mounted on the combustion chamber floor, (l) a gas-fired burner element disposed in the bracket in a horizontal position above the floor panel, and parallel to the blower axis, the burner element being adapted to produce a horizontal flame when the heater is operating, (m) an opening in the mixing chamber roof for admitting hot air through the combustion chamber floor panel, (n) an arcuate baffle plate disposed in the opening with one end attached to the combustion chamber floor, and with its opposite end extending downwardly into the mixing chamber, the baffle plate being disposed so that the horizontal flame is drawn across the baffle arc to terminate opposite the blower when it is operating, and wherein the distance of the burner element above the combustion floor panel, and the length of the baffle plate arc are such that the burner flame terminates at the end of the baffle rather than in the blower.

4. In an agricultural heater of the forced air type in the form of a parallelepiped housing having assembled therein (1) a blower with its axis adapted to receive a motor, (2) a blower outlet, (3) a motor attached to the blower axis to drive the blower, (4) a combustion chamber adapted to house a burner element, a flame-controlling baffle, and a heating zone, (5) a mixing zone in which heated air and incoming air combine, and (6) openings for flow of incoming air to the heating and mixing zones, the improvement wherein (a) a burner element support is mounted in the combustion chamber, wherein (b) a gas-fired burner element is horizontally disposed on the burner element support on a line substantially parallel to the blower axis, wherein (c) the burner element is adapted to produce a horizontal flame directed toward the blower when the heater is operating, wherein (d) the flame-controlling baffle is in the form of an arc disposed in the heater with one end attached to the combustion chamber and an opposite end extending downwardly into the mixing zone opposite the blower inlet, and wherein (e) the baffle is not disposed as high as the burner element so that the horizontal flame is drawn across the baffle arc and into the mixing zone when the blower is operating, the length of the baffle plate arc being such that the burner flame terminates at the end of the baffle rather than in the blower.

5. In an agricultural heater of the forced air type in the form of a parallelepiped housing having assembled therein (1) a blower with its axis adapted to receive a motor, (2) a blower outlet, (3) a motor attached to the blower axis to drive the blower, (4) a combustion chamber adapted to house a burner element, a flame-controlling baffle, and a heating zone, (5) a mixing zone in which heated air and incoming air combine, and (6) openings for flow of incoming air to the heating and mixing zones, the improvement wherein (a) a burner element support is mounted in the combustion chamber, wherein (b) a gas-fired burner element is horizontally disposed on the burner element support on a line substantially parallel to the blower axis, and wherein (c) the burner element is adapted to produce a horizontal flame directed toward the blower when the heater is operating, and wherein (d) the blower outlet has attached to the top thereof a hot air deflection plate.

6. In an agricultural heater of the forced air type in the form of a parallelepiped housing having assembled therein (1) a combustion chamber adapted to house a burner element, (2) a blower with its axis adapted to receive a motor, (3) a motor attached to the blower axis to drive the blower, (4) openings to the combustion chamber for flow of incoming air (5) a burner element vertically disposed between deflecting baffles with a flame from the burner element being guided by the baffle above the flame, that baffle being adapted to divert a flame from the burner element to the blower as it flows along the underside of the baffle, and (6) a blower outlet, the improvement wherein (a) the burner element is horizontally disposed on a line substantially parallel to the blower axis, wherein (b) one of the deflecting baffles is in the form of an arcuate panel disposed between the burner element and the blower, and wherein (c) the blower is adapted to draw a flame from the burner element across the top surface of that arcuate baffle when the heater is operating.

7. The heater of claim 6 wherein the blower outlet has attached to the top thereof a hot air deflection plate.

* * * * *